United States Patent [19]

Lotz

[11] Patent Number: 4,727,736

[45] Date of Patent: Mar. 1, 1988

[54] LOCK AND METHOD OF FASTENING SAME

[75] Inventor: Edwald Lotz, Obertshausen, Fed. Rep. of Germany

[73] Assignee: Amiet AG, Oberdorf, Switzerland

[21] Appl. No.: 826,144

[22] Filed: Feb. 3, 1986

[30] Foreign Application Priority Data

Feb. 8, 1985 [CH] Switzerland ..... 572/85

[51] Int. Cl.[4] ..... E05B 9/08

[52] U.S. Cl. ..... 70/312; 70/443; 70/451; 70/466; 190/120; 248/27.1; 292/DIG. 53; 403/283; 403/405.1

[58] Field of Search ..... 70/69–71, 70/312, 443, 448, 466, DIG. 40, 208, 452, 451; 190/120–123; 248/27.1; 403/283, 405.1; 339/131; 292/337, 353, 253, DIG. 31, DIG. 53, DIG. 64

[56] References Cited

U.S. PATENT DOCUMENTS

| | | | |
|---|---|---|---|
| 981,843 | 1/1911 | Davis | 70/71 |
| 1,585,799 | 5/1926 | Stone | 70/70 |
| 1,876,081 | 9/1932 | Schlage | 70/448 |
| 1,877,612 | 9/1932 | Stieglitz | 70/71 X |
| 1,999,454 | 4/1935 | Haan | 292/356 |
| 2,523,526 | 9/1950 | Sciurba | 292/253 |
| 2,586,728 | 2/1952 | Shepard | 248/DIG. 6 X |
| 2,662,388 | 12/1953 | Hillgren | 292/358 |
| 2,956,827 | 10/1960 | Humphries | 70/70 |
| 3,057,388 | 10/1962 | Lifton | 190/122 |
| 3,590,609 | 7/1971 | Atkinson | 70/70 |
| 3,733,865 | 5/1973 | Vorob | 70/370 |
| 4,038,718 | 8/1977 | Reilhac et al. | 292/DIG. 31 X |
| 4,183,486 | 1/1980 | Esoldi | 248/DIG. 6 X |
| 4,324,120 | 4/1982 | Gisiger | 70/312 |
| 4,420,956 | 12/1983 | Li | 70/312 |
| 4,576,349 | 3/1986 | Dearing | 248/27.1 |
| 4,603,827 | 8/1986 | Greenberg | 248/27.1 X |
| 4,623,110 | 11/1986 | Kanari | 248/27.1 |

FOREIGN PATENT DOCUMENTS

| | | | |
|---|---|---|---|
| 1897329 | 5/1964 | Fed. Rep. of Germany . | |
| 1532836 | 5/1973 | Fed. Rep. of Germany | 70/69 |
| 2352815 | 4/1975 | Fed. Rep. of Germany | 70/69 |
| 1205932 | 8/1959 | France | 70/69 |

*Primary Examiner*—Lloyd A. Gall

*Attorney, Agent, or Firm*—Werner W. Kleeman

[57] ABSTRACT

A lock possesses a lock housing which is connected with a cover plate protruding above the lock housing at all sides. Fastening clips which abut at the corresponding side walls of the lock housing and protrude beyond the rear or rear side thereof are arranged at at least two oppositely positioned sides of the lock housing. The lock is fastened to a flat object by inserting it into an opening through the flat object and bending over the fastening clips on the rear side of this flat object. A substantial simplification of the manufacture of the lock and its fastening in an opening of the flat object is possible due to this form of construction.

3 Claims, 3 Drawing Figures

LOCK AND METHOD OF FASTENING SAME

BACKGROUND OF THE INVENTION

The present invention broadly relates to a new and improved construction of a lock.

In its more specific aspects the present invention relates to a new and improved construction of a lock comprising a lock housing flush mounted in an opening of a flat object. The lock is connected with a cover plate which protrudes beyond the lock housing on all sides.

The present invention also relates to a method of fastening such a lock to a substantially flat object.

Locks of the abovementioned type are commonly known, for example from Swiss Pat. No. 630,990 granted July 15, 1982 and which is cognate to U.S. Pat. No. 4,324,120, granted Apr. 13, 1982. For fastening purposes it has heretofore been conventional practice to introduce bores or holes in the four corner regions through which the cover plate, and thus the lock, can be riveted to the flat object. This type of fastening required the introduction of holes into the cover plate and the flat object as well as a complicated riveting process.

SUMMARY OF THE INVENTION

Therefore, with the foregoing in mind, it is a primary object of the present invention to provide a new and improved construction of a lock which does not exhibit the aforementioned drawbacks and shortcomings of the prior art constructions.

A further important object of the present invention is to improve the construction of a lock of the abovementioned type such that it is simpler and cheaper to manaufacture and furthermore can be fastened to an object in a simpler and more economical fashion.

Now in order to implement these and still other objects of the present invention which will become more readily apparent as the description proceeds, the lock of the present development is manifested by the features that fastening clips which abut against the corresponding or related side walls of the lock housing and protrude beyond the rear of the lock housing are arranged at at least two oppositely positioned ends of the lock housing.

The method of the present invention is manifested by the features that it comprises the steps of inserting a lock housing of the lock into a lock opening extending through a substantially flat object such that a flange of the lock housing overlies a first surface of the substantially flat object, and such that fastening clips of the lock housing protrude beyond a second surface of the flat object, and subsequently bending over the fastening clips to bear against the second surface and thereby fasten the lock in place.

Due to the arrangement of the fastening clips at the lock housing additional bores or holes at the cover plate are no longer necessary. Furthermore, there is no requirement for additional holes in the flat object to which such a lock is to be fastened due to the fact that the fastening clips can be inserted into the same opening as the lock itself, since the fastening clips bear or lie flat against the corresponding sides or side walls of the lock housing. Thus, it merely requires a simple bending over of the fastening clips in order to fasten the lock in the flat object. Consequently, the assembly or fastening of such a lock in a flat object is substantially simpler and cheaper than in heretofore known solutions.

In one advantageous embodiment of the present invention, a fastening staple or pin is fixed to the fastening plate and points in the direction of the lock housing i.e. extends in a direction substantially parallel to the neighboring side wall of the lock housing.

In another possible embodiment, the fastening clips can be integrally formed during the operation of punching or pressing of a sheet metal component intended for the lock housing and brought into final position by bending. However, it is more advantageous for the fastening clips to be more simply formed integrally with the fastening plate which is generally provided in such a lock. It is especially advantageous for the fastening plate to be of a frame-type construction and to completely surround the lock housing. Then, during the punching or pressing of such a frame-type fastening plate the waste material obtained from forming the opening can be used for forming the fastening clips. This results in a particularly economical manufacture of the lock as no additional operations are necessary. In fact, the fastening clips can be produced directly in the operation of the manufacture of the fastening plate.

The fastening of the lock in a flat object can be improved in that fastening staples or pins are formed in the fastening plate and introduced into the flat object.

BRIEF DESCRIPTION OF THE DRAWINGS

The invention will be better understood and objects other than those set forth above will become apparent when consideration is given to the following detailed description thereof. Such description makes reference to the annexed drawings wherein throught the various figures of the drawings there have been generally used the same reference characters to denote the same or analogous components and wherein.

DETAILED DESCRIPTION OF THE PREFERRED EMBODIMENTS

Figure 1:
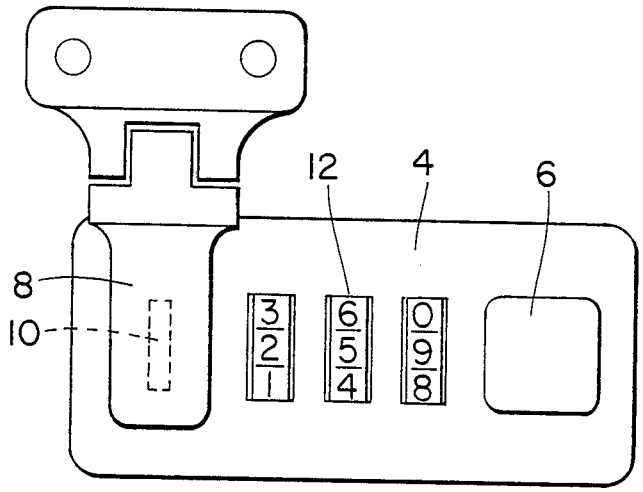
FIG. 1 shows a top plan view of an exemplary embodiment of a lock of the present invention constructed as a combination lock.
Figure 2:
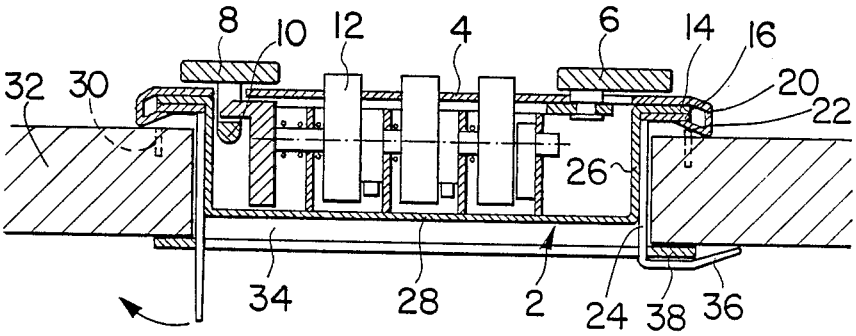
FIG. 2 shows a longitudinal section of the lock in accordance with FIG. 1 fastened in a substantially flat object.

Describing now the drawings, it is to be understood that to simplify the showing thereof, only enough of the structure of the lock has been illustrated therein as is needed to enable one skilled in the art to readily understand the underlying principles and concepts of the present invention. Turning now specifically to FIGS. 1 and 2 of the drawings, the apparatus illustrated therein by way of example and not limitation will be seen to comprise a lock which in the instant example is constructed as a combination or number lock.

The lock comprises a lock housing 2 for flush mounting which is covered by and connected with a cover plate 4. The cover plate 4 protrudes beyond the lock housing 2 on all sides. An operating slide or button 6 is provided at the cover plate 4 which can release a closing portion 8 equipped with or engaging a locking hasp. The combination lock possesses conventional locking devices which are not here further described and which can be brought into an open or locked position by means of adjusting wheels 12.

As can be especially well seen from FIG. 2, flanges or flange portions 14 are formed on the lock housing 2 with which the lock housing 2 abuts on or bears against the underside of the cover plate 4. A frame-shaped fastening plate 16 serves to press or support the lock against or in overlying relationship to a first or front side or surface of a substantially flat object 32 into which it is to be countersunk and which surrounds the lock housing 2. Clips or securing brackets 22 are formed on an edge 20 of the cover plate 4. The edge 20 protrudes downwards and the clips 22 are bent up toward the fastening plate 16 and lock this fastening plate 16 and thus also the lock housing 2 and the cover plate 4 together. The fastening clips or securing brackets 24 which extend along and abut against associated side walls 26 of the lock housing 2 are formed on the side of the fastening plate 16 facing the lock housing 2. The fastening clips or securing brackets 24 point or protrude beyond a rear wall or rear side 28 of the lock housing 2. Projecting fastening staples or pins 30 are integrally formed with the fastening plate 16 on the side of the fastening plate 16 facing away from the lock housing 2.

As can be further seen from FIG. 2, the lock is arranged in an opening of the substantially flat object 32, for example a suitcase wall. For this purpose the lock housing 2 can be inserted or sunk into a lock opening 34 of the flat object 32, whereby the fastening clips 24 also engage or pass through this same lock opening 34. On the side facing away from the cover plate 4 the fastening clips 24 are bent back against a second or rear side or surface of the flat object 32 and thus fasten or fix the lock against the flat object 32. A frame 38 may advantageously be arranged between the bent-over sections 36 of the fastening clips 24 and the flat object 32 in order to enhance the stability of the fastening.

The fastening plate 16 with the fastening clips 24 and the fastening staples or pins 30 is advantageously manufactured by means of pressing, stamping or bending and, importantly, the portion of the material which has to be removed for forming the opening for the lock housing 2 is used to manufacture the fastening clips or securing brackets 24.

Figure 3:
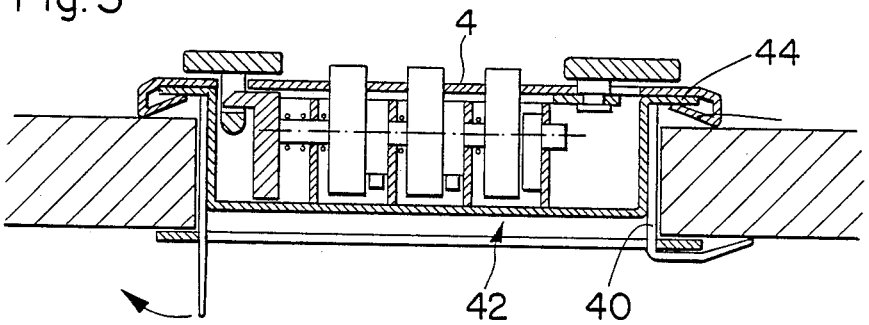
FIG. 3 shows a further exemplary embodiment of the lock in accordance with FIG. 1 in an illustration analogous to FIG. 2.

FIG. 3 shows a further exemplary embodiment of a lock in which the fastening clips 40 are formed directly on the lock housing 42. These fastening clips 40 are also manufactured by means of pressing a metal plate component and appropriate stamping and bending operations. The lock housing 42 is again secured or fastened via flange portions 44 thereof to the cover plate 4, whereby the clips 22 of the cover plate 4 can either engage directly on to the flange portion 44, as is shown in the previous exemplary embodiment or can be fastened by interposing a frame type of fastening plate similar to the fastening plate 16 of FIG. 2, but without its fastening clips or securing brackets 24.

While there are shown and described present preferred embodiments of the invention, it is to be distinctly understood that the invention is not limited thereto, within the scope of the following claims. Accordingly,

What I claim is:

1. The combination of a lock having a lock housing and a substantially flat object having an opening, said lock housing being substantially flus mounted in the opening of the substantially flat object, comprising:

a cover plate connected to the lock housing and protruding beyond said lock housing on all sides thereof;

said lock housing having a plurality of sides, a plurality of side walls and a rear wall;

said lock housing extending with said plurality of side walls and said rear wall into said opening of the substantially flat object;

at least one respective fastening clip arranged on each of at least two mutually opposite sides of said plurality of sides;

each said at least one respective fastening clip extending in neighboring relationship along an associated side wall of said plurality of side walls and protruding beyond said rear wall;

said lock housing together with said plurality of side walls and said rear wall and each said at least one respective fastening clip extending through the same said opening of the substantially flat object;

a fastening plate;

each said at least one respective fastening clip being formed integrally with said fastening plate;

said lock housing having a flange portion; and said fastening plate engaging with said cover plate so as to retain said flange portion against said cover plate and said fastening plate.

2. The combination as defined in claim 1, wherein:

said fastening plate is provided with fastening staples formed integrally therewith and extending in a direction substantially parallel to said side walls of said lock housing.

3. The combination as defined in claim 1, wherein:

each said at least one respective fastening clip extending in abutting relationship with respect to said associated side wall of said plurality of side walls and protruding beyond said rear wall.

* * * * *

UNITED STATES PATENT OFFICE
CERTIFICATE OF CORRECTION

PATENT NO. : 4,727,736

DATED : March 1, 1988

INVENTOR(S) : EWALD LOTZ

It is certified that error appears in the above-identified patent and that said Letters Patent are hereby corrected as shown below:

Column 1, line 33, please delete "manau-" and insert --manu- --

Column 2, line 33, please delete "throught" and insert --throughout--

Column 4, line 8, after "thereto," please insert --but may be otherwise variously embodied and practiced--

Column 4, claim 1, line 3, please delete "flus" and insert --flush--

Signed and Sealed this

Ninth Day of August, 1988

*Attest:*

DONALD J. QUIGG

*Attesting Officer*

*Commissioner of Patents and Trademarks*